United States Patent [19]

Allenbaugh

[11] 4,268,075

[45] May 19, 1981

[54] LOCK OF THE DEAD BOLT TYPE

[76] Inventor: Howard M. Allenbaugh, 16360 Sandalwood St., Fountain Valley, Calif. 92708

[21] Appl. No.: 33,179

[22] Filed: Apr. 25, 1979

Related U.S. Application Data

[63] Continuation-in-part of Ser. No. 923,912, Jul. 12, 1978.

[51] Int. Cl.[3] ..... E05C 1/16

[52] U.S. Cl. ..... 292/167

[58] Field of Search ..... 292/139, 167, 169, 199.23

[56] References Cited

U.S. PATENT DOCUMENTS

| | | | |
|---|---|---|---|
| 854,847 | 5/1907 | Schmitt | 70/149 |
| 3,606,422 | 9/1971 | Hennessy | 292/139 |
| 3,702,549 | 11/1972 | Solouieff et al. | 292/139 X |

*Primary Examiner*—Richard E. Moore

*Attorney, Agent, or Firm*—Fulwider, Patton, Rieber, Lee & Utecht

[57] ABSTRACT

A door lock of the dead bolt type in which an eccentric cam on the inner end of a lock cylinder can be rotated to engage a deformation in a ring, causing the ring to rotate. A linkage connects the ring to a bolt so that rotation of the ring causes reciprocation of the bolt, the ring being concentric with and supported by the cylinder. An engagement portion of the ring that extends beyond the cylinder forms the deformation, preferably a recess, permitting the cam to engage and disengage the recess as it makes a complete revolution. The cam engages opposite ends of the recess to move the bolt in opposite directions. A spring, that can be disposed within the bolt, is used to bias the ring toward positions corresponding to extended and retracted positions of the bolt.

A catch mechanism can be provided to engage a housing and resist movement of the bolt if the bolt is forced toward its retracted position.

29 Claims, 11 Drawing Figures

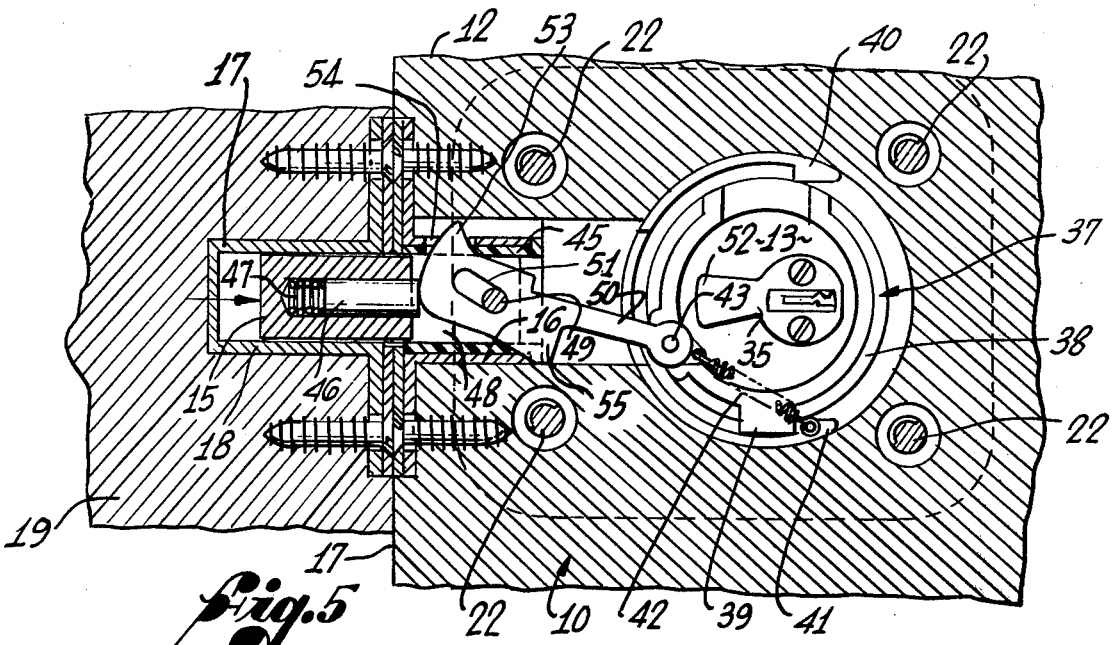
Fig.5
Fig.6
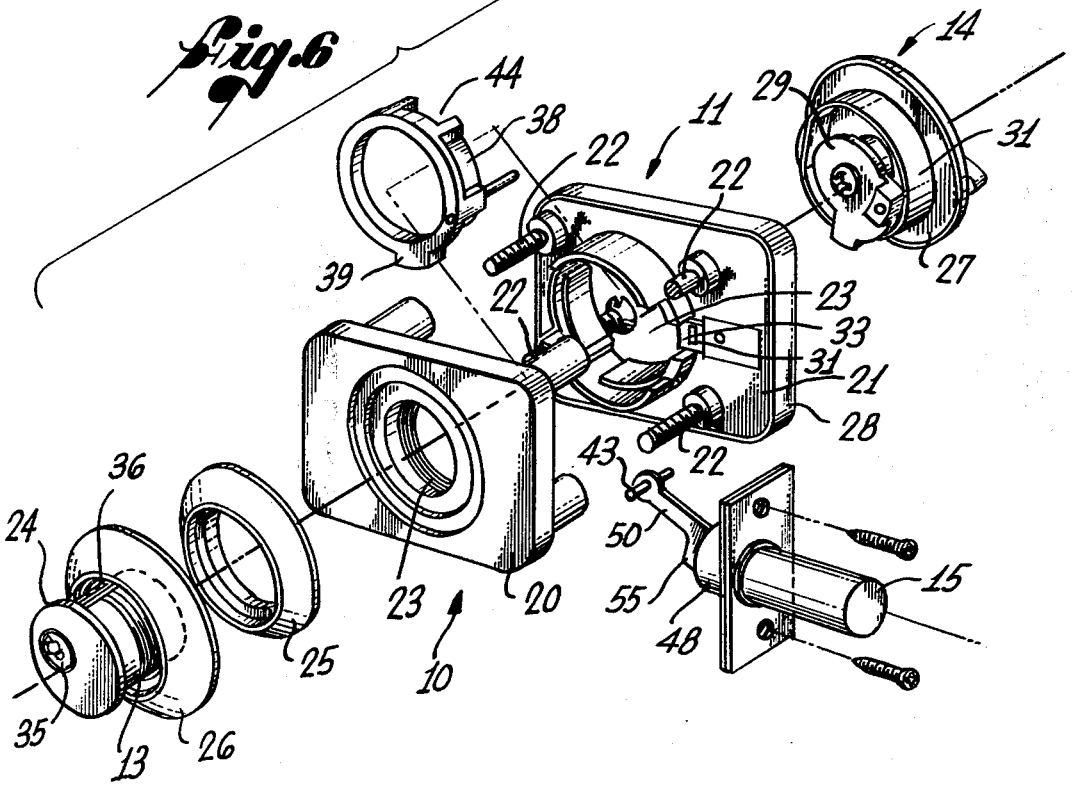

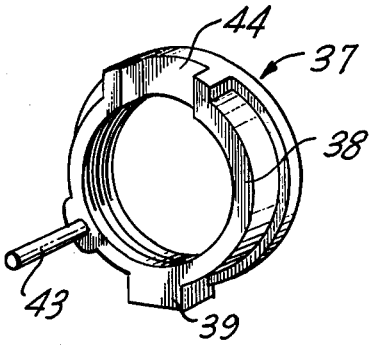
Fig. 11
Fig. 7
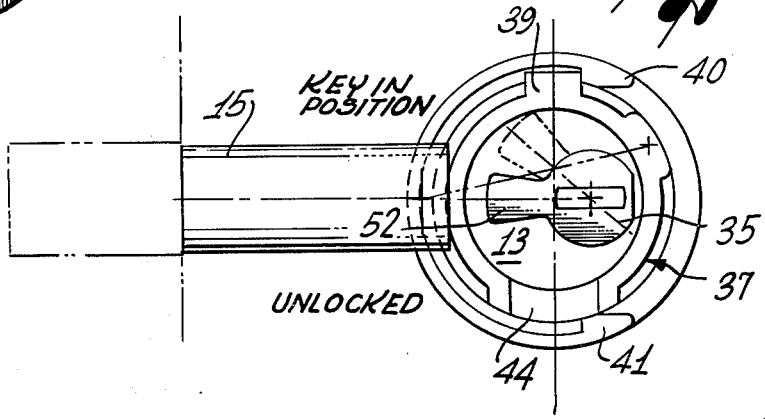
Fig. 8
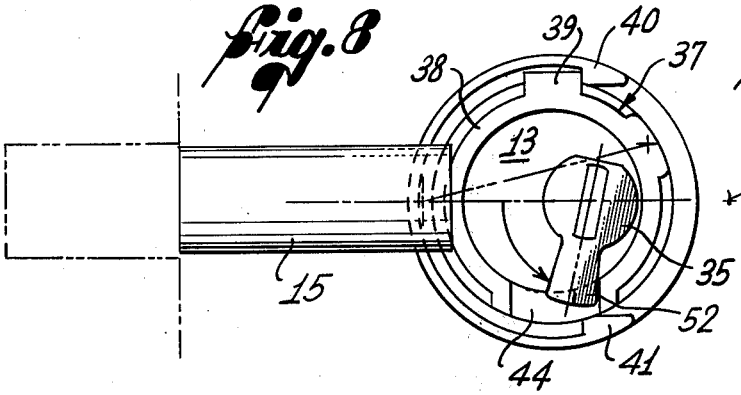
Fig. 9
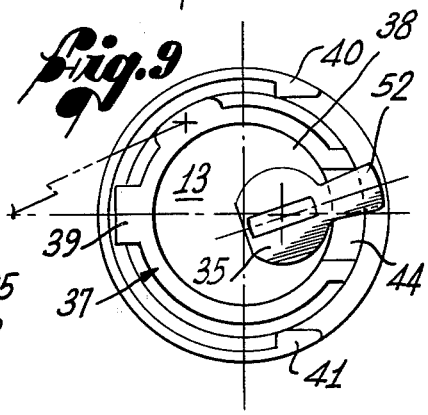
Fig. 10
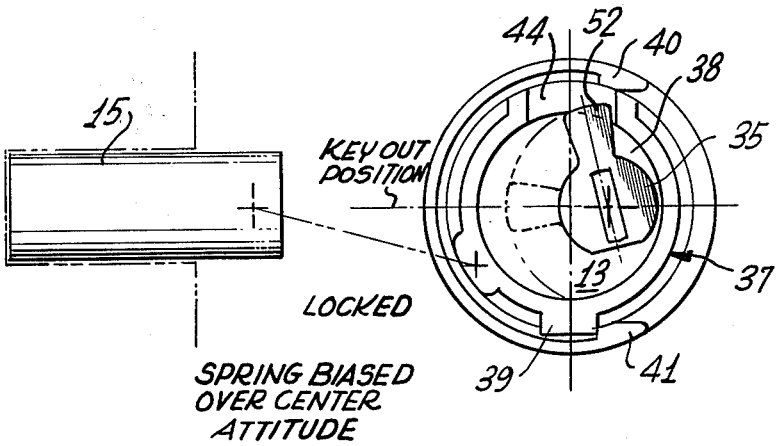

LOCK OF THE DEAD BOLT TYPE

RELATED APPLICATIONS

This is a continuation-in-part of application Ser. No. 923,912, filed on July 12, 1978 and entitled LOCK WITH IMPROVED PROVISIONS FOR WITHSTANDING FORCES APPLIED TO THE BOLT.

FIELD OF THE INVENTION

The present invention is related to locks of the dead bolt type, and, more particularly, to the connection between the bolt and the cylinder of such a lock.

BACKGROUND OF THE INVENTION

A conventional dead bolt door lock is constructed so that it can incorporate any of a large variety of interchangeable externally threaded lock cylinders that are commercially available from a variety of sources. On the inner end of the cylinder, an eccentric cam is rotatably mounted, and a linkage must be provided that causes recipricatory movement of a bolt between retracted and extended positions in response to movement of the cam.

A wide variety of arrangements for transmitting the motion of the cam to the bolt have been proposed. One important requirement has been that relatively strong and heavy components must be used, enabling the bolt to withstand any effort to disable the lock by driving it forcefully back toward its retracted position. These connecting components are not only costly, but they sometimes make the lock difficult to operate, offering high resistance to bolt movement.

Another important disadvantage of conventional dead bolt locks is that it is generally possible to rotate the cam in the wrong direction through a large angle, sometimes approaching a full turn. This makes the operation of the lock confusing, particularly where there are several locks on a single door so that it is difficult for the user to determine whether he or she has properly actuated the bolt.

Another disadvantage of a conventional dead bolt is that the key must be rotated in a first direction, and then counterrotated, thereby returning to its original position so that it can be withdrawn. In many cases, the user does not rotate the key through a large enough angle to fully extend the bolt before counterrotating and removing it. The result is that the bolt remains in a partially extended position and the door has the appearance of being locked, but the bolt offers almost no resistance if pushed toward its retracted position by an external force.

A principle objective of the present invention is to provide an improved dead bolt lock that overcomes the above-mentioned operational disadvantages of conventional locks. A further objective is to provide such a lock that is particularly well suited for relatively inexpensive lightweight construction and offers a minimum resistance to operation without sacrificing the strength of the lock.

SUMMARY OF THE INVENTION

The present invention resides in a door lock of the dead bolt type in which motion is transmitted from the cam of a lock cylinder to a bolt by a rotatable ring concentric with the lock cylinder and a linkage that extends from the ring to the bolt. As the cam is rotated, it engages a deformation on the ring, thereby moving the ring between first and second positions corresponding to retracted and extended positions of the bolt.

Preferably, the ring is supported by the cylinder, thus eliminating the need for any other ring-supporting structure. It includes an engagement portion that extends beyond the cylinder and carries the deformation. Most advantageously, the deformation is a recess in which the cam is receivable, opposite ends of the recess being engageable by the cam to rotate the ring toward its first and second positions. One or more springs urge the ring toward either of these positions.

The ring and cam are shaped and dimensioned so that the cam can make a complete revolution within the ring, engaging and disengaging the deformation as it does so. It is, therefore, possible to operate the lock by inserting the key, making a single revolution, and then removing the key without counterrotating it. The construction of the of the lock thus eliminates the possibility that its user will inadvertently leave the bolt in a partially extended position as a result of having reversed the rotation of the key without having first moved it through a sufficient angle. In addition, the ring limits rotation of the key away from the deformation to less than one-half of a turn so that the user will quickly become aware of his mistake if he attempts to turn the key in the wrong direction.

According to another aspect of the invention, the structure described above is combined with a catch mechanism that opposes any force applied to the bolt in the direction of its retracted position and prevents this force from being transmitted to the ring. Because of this catch mechanism, the ring and its associated components, which need not be capable of withstanding a force applied to the bolt, can be of a light, inexpensive and easily operated construction.

To accommodate the catch mechanism, the lock includes a housing in which the bolt is reciprocable and an abutment carried by the housing. The catch means includes a prong that is forced upwardly by a pin-and-slot connection into engagement with the abutment as the bolt is pushed toward its retracted position. A spring can be disposed within the bolt to facilitate the smooth operation of the catch mechanism while, simultaneously, urging the ring toward its first and second positions.

Other features and advantages of the present invention will become apparent from the following detailed description, taken in conjunction with the accompanying drawings which illustrate, by way of example, the principles of the invention.

BRIEF DESCRIPTION OF THE DRAWINGS

FIG. 5 is another cross-sectional view similar to FIG. 3 but illustrating the lock as an external force is applied to the bolt driving it toward its retracted position;

FIG. 6 is a three-dimensional, exploded view of the lock;

FIG. 7 is a plan view of a fragmentary portion of the lock with the bolt in its retracted position;

FIGS. 8 and 9 are similar to FIG. 7 showing the lock in various intermediate positions as it moves toward its extended position;

FIG. 10 is another view similar to FIG. 7 showing the bolt in its fully extended position; and FIG. 11 is a perspective view of the ring and connection pin of the lock.

DESCRIPTION OF THE PREFERRED EMBODIMENTS

Figure 1:
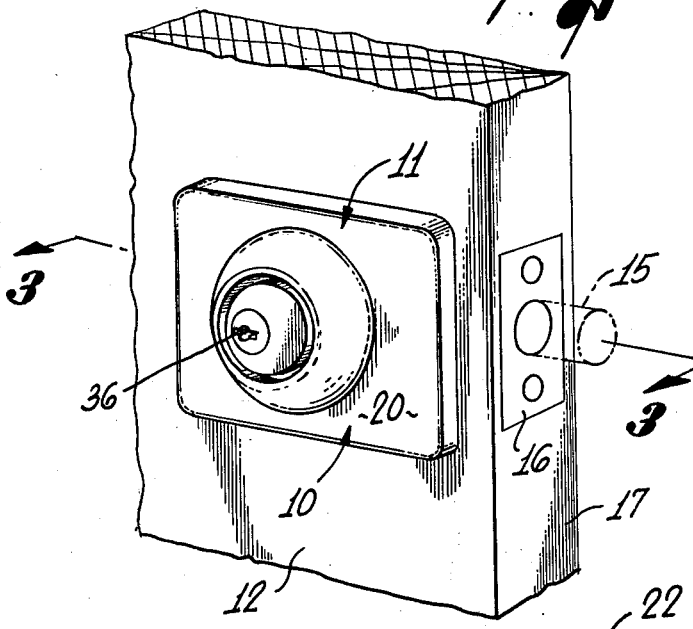
FIG. 1 is a perspective view of a door lock of the dead bolt type constructed in accordance with the present invention, the lock being installed in a door, a fragmentary portion of which is illustrated, with the bolt of the lock shown in phantom lines in its extended position.
Figure 2:
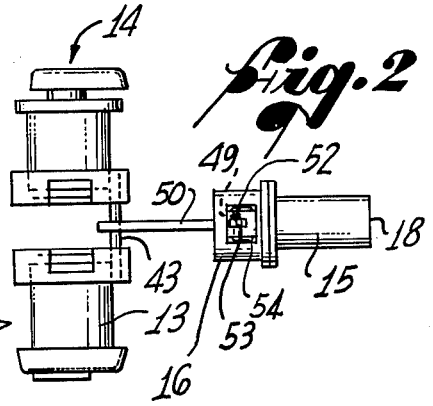
FIG. 2 is a plan view of a portion of the lock of FIG. 1 including the lock cylinder, ring, linkage and bolt.
Figure 3:
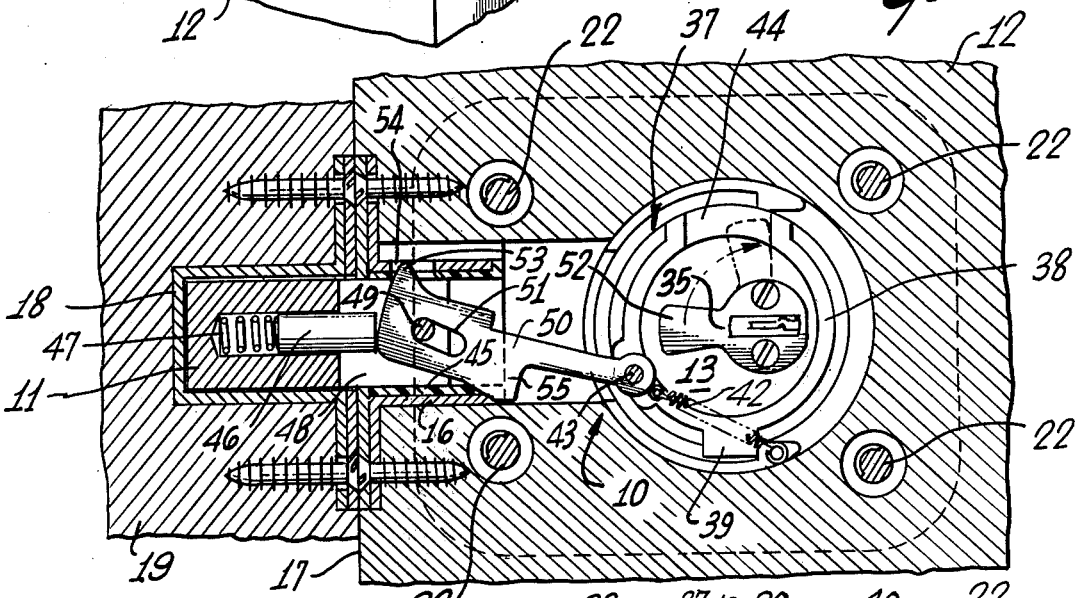
FIG. 3 is a cross-sectional view of the lock taken along the line 3—3 of FIG. 1 but showing the bolt in its extended position.
Figure 4:
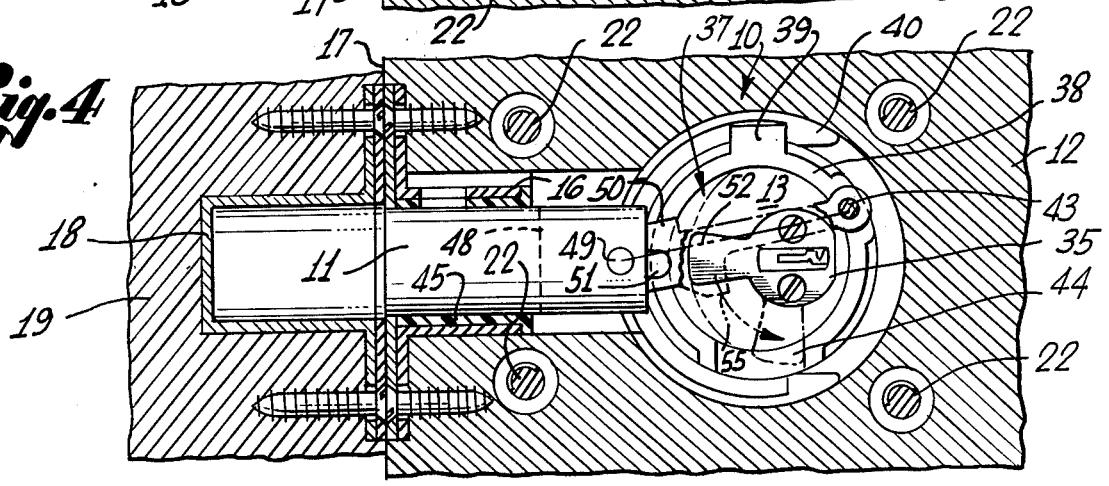
FIG. 4 is a cross-sectional view similar to FIG. 3 but showing the bolt in its retracted position, a portion of the linkage between the bolt and the ring being broken away to expose other components, the bolt not being sectioned.

An exemplary door lock 10 of the dead bolt type, illustrated in FIGS. 1 through 11 of the accompanying drawings, embodies many novel aspects of the present invention. In general, it includes a mounting 11 secured to a door 12, a lock cylinder 13 supported by the mounting, a thumb-turn assembly 14 supported by the mounting on the opposite side of the door from the cylinder, a bolt 15 and housing 16 mounted in an edge 17 of the door in which the bolt is received. The bolt can reciprocate between a retracted position within the door, as shown in FIG. 4, and an extended position in which it projects into a socket 18 in the door frame 19, as shown in FIG. 3.

The mounting 11 includes two escutcheon plates 20 and 21 held against opposite sides of the door 12 and four through bolts 22. The bolts are positioned so that their heads engage the interior escutcheon plate 21 while they are threadedly received by sockets in the exterior plate 20. A relatively large transverse opening through the door 12 is aligned with a round aperture 23 in each escutcheon plate.

The cylinder 13, sometimes referred to as a mortise cylinder, is of conventional construction and is positioned within the door opening. It is threaded to mate with the aperture 23 of the exterior escutcheon plate 20 and has a flange 24 on its outer end to hold an annular cylinder guard 25 and decorative cover 26 against the outer surface of the plate. The cylinder is anchored against rotation by a pair of screws (not shown) that project vertically through the exterior escutcheon plate 20 into grooves 31 that extend axially across the threads of the cylinder.

The aperture 23 of the interior escutcheon plate 21 receives the thumb-turn assembly 14, opposing the cylinder 13, that is generally cylindrical having a flange 27 that engages the outer surface of the escutcheon plate and its decorative cover 28. On the inside of the thumb-turn assembly is a rotatable plate 29 rigidly connected to a thumb-turn handle 30 on the outside side of the interior escutcheon so that the plate can be rotated by the handle. On the cylindrical surface of the thumb-turn assembly 14 is a slot 32 that faces the edge of 17 of the door 12. A latch member 33 is slidably mounted on the inside of the interior escutcheon plate 21 and biased by a spring (not shown) into engagement with the slot to prevent axial withdrawal of the thumb-turn assembly. To release and remove the thumb-turn assembly, a tool can be inserted from the edge of the door, after the bolt 15 and its housing 16 have been removed, to grasp the latch member by a depression 34 and withdraw it from the slot.

On the inner end of the cylinder 13 is an eccentrically mounted cam 35 attached to a cylinder core 36 that can be rotated once a key has been inserted. As is conventional in cylinders of this type, there is only one position of the core in which the key (not shown) can be inserted and removed. With the core in this position, the cam is symmetrically oriented on the inner end of the cylinder (as shown in FIGS. 3, 4, 5, and 7) and does not extend radially beyond the perimeter of the cylinder. When the core is rotated, however, the cam, because of its eccentricity, extends beyond the perimeter of the cylinder (as shown in FIGS. 8 and 9, 10 and in phantom lines of FIGS. 3 and 4), its position of maximum extension being separated from the key insertion position by 180 degrees.

The element that interacts directly with the cam 35 to bring about movement of the bolt 15 is a ring 37 (shown separately in FIG. 11) that is internally threaded to receive the external threads of the cylinder 13. The ring is freely rotatable on the cylinder by which it is supported, and its rotation produces no significant axial movement because of the fine pitch of the threads. It includes an arcuate engagement portion 38 that extends axially beyond the inner end of the cylinder, the inside diameter of this engagement portion being equal to the diameter of the cylinder.

A lug 39 projects radially from the surface of the ring 37 to engage either of two stops 40 and 41 that are integrally formed on the exterior escutcheon plate 20 at the top and bottom of the aperture 23. A coil spring 42 in tension biases the ring so that, when free to rotate, it will move to a position in which the lug engages the nearest stop, the two stop engaging positions being separated by 180 degrees. The spring is attached at one end to the exterior escutcheon plate and at its opposite end to a connection pin 42 that extends from the ring to the rotatable plate 29 of the thumb-turn assembly 14. Thus, in addition to its function of securing the spring, the connection pin fastens the ring to the thumb-turn plate for joint rotation.

The engagement portion 38 of the ring 37 is interrupted by a discontinuity in the form of a recess 44 positioned diagonally opposite the lug 39. The purpose of this recess, as explained in greater detail below, is to receive the cam 35 to cause rotation of the ring in response to movement of the cam.

The bolt 15 is a cylindrical steel member that rides in a low friction plastic sleeve 45 within the bolt housing 16. Extending from the inner end of the bolt is an axial bore that receives a free-turning hardened steel security pin 46. This pin will resist any effort to saw through the bolt since it will rotate when engaged by the teeth of a saw, preventing the saw from biting into the steel. The security pin is biased away from the outer end of the bolt by a compression spring 47 disposed between the pin and the end of the bore.

At its inner end, the bolt 15 is bifurcated to form two parallel vertical plates 48 connected by a horizontal bolt pin 49 (best shown in FIG. 2) that extends transversely with respect to the door 12. An elongated bolt link 50 has a slot 51 in which the bolt pin is received, the link having a round aperture in at its opposite end in which the connection pin 43 is loosely journaled. Thus, the bolt pin, bolt link and connection pin form a linkage by which the bolt is connected to the ring 37.

The slot 51 in the bolt link 50 is inclined from the horizontal direction of bolt movement so that, with the bolt 15 in its fully extended position, the outer end of the slot is higher than the inner end. One function of the compression spring 47 is to bias the bolt outwardly away from the security pin 46 so that the bolt pin 49 remains at the raised outer end of the slot.

When the ring 37 occupies its first position abutting the first stop 40, the connection pin 43 is located on the side of the cylinder 13 away from the bolt 15 and the bolt is secured in its retracted position (FIGS. 4 and 8). With the ring in its second position abutting the second stop 41, however, the connection pin is located on the side of the cylinder nearest the bolt and the bolt link 50 then extends further from the cylinder securing the bolt in its extended position (FIGS. 3 and 10).

The operation of the lock 10 begins with the bolt 15 in its retracted position (as shown in FIGS. 4 and 7), the ring 37 in its corresponding first position with the lug 39 engaging the first stop 40 and the cylinder core 36 in its key insertion position (FIG. 1). The cam 35, which includes a lobe 52 that extends toward the bolt, is located completely within the perimeter of the cylinder 13. To lock the door 12, the key is inserted and the cam is caused to rotate counterclockwise (with reference to FIGS. 3–5 and 7–10). After less than 90 degrees of rotation the lobe extends downwardly and almost vertically into the recess 44 (FIG. 8). Continued rotation of the cam, pressing against one end of the recess, forces the ring to rotate, thereby stretching the tension spring 42. Once the ring has been displaced about 90 degrees (FIG. 9), the spring will have been stretched to the maximum extent and, upon further rotation, will begin to pull the ring toward its second position.

When the recess 44 is located at the top of the cylinder 13, the lug 39 abuts the second stop 40 to halt rotation of the ring 37 (FIG. 10). At this point, continued rotation of the cam 35 brings the cam lobe 52 back within the perimeter of the cylinder and withdraws it from the recess so that the cam can complete a full revolution (FIG. 3), allowing the cylinder core 35 to return to its original position in which the key can be withdrawn.

To retract the bolt 15, the key is again inserted but is rotated in the opposite direction so that the cam lobe 52 rises to re-engage the ring 37, bearing against the opposite end of the recess 44 from that which it engaged when the bolt was being extended. The cam 35 then rotates clockwise (with reference to FIGS. 3–5 and 7–10) again stretching the tension spring 29 until it passes the half-way point and the lobe 39 is again withdrawn from the recess as it reaches the downward position. After a complete rotation of the cylinder core 36, the key can be withdrawn again. The ring then remains in its first position, corresponding to the retracted position of the bolt, with the lug 39 abutting the first stop 40.

It is not possible to withdraw the key when the bolt 15 is in a partially extended position; the cylinder core 36 must make a complete revolution. It is, therefore, impossible to rotate the cylinder core without moving the ring 37 fully from one of its two positions with the other.

Another advantage of the lock 10 is that it is not possible to inadvertently rotate the cylinder core 36 as much as one-half of a turn in the wrong direction. If, for example, an attempt is made to rotate the core clockwise (with reference to FIG. 7) when the bolt 15 is in its retracted position, the cam 35 can be displaced only about 45 degrees before its movement is limited by the engagement portion 38 of the ring 37 (as indicated in phantom lines in FIG. 7). A similar result is obtained if an effort is made to rotate the cam so that the lobe 52 moves downwardly away from the recess 44 when the bolt is in its extended position.

It should be noted that the compression spring 47 urges the bolt link 50 back into the door 12 and in this way duplicates the function of the tension spring 29, i.e., it biases the ring 37 toward its first and second positions in which the lug 39 engages the stops 40 and 41. Although it is advantageous to have two springs perform this function, either spring alone could supply a sufficient biasing force.

Although the preferred embodiment of the lock 10 described here includes a single key-operated cylinder 13 and a thumb-turn assembly 14, the principals of the invention can also be employed in a double cylinder lock. The two halves of the lock would then be mirror images of each other, and the lock would include two rings 37 joined by the connection pin 43.

Preferably, the ring 37 is made of plastic and neither the ring nor the connection pin 43 need be of sufficient strength to withstand a force that might be applied to the bolt 15 in an effort to disable the lock by driving the bolt toward its retracted position. A unique catch mechanism prevents any such force from being transmitted by the link 50 to the connection pin.

As part of the catch mechanism, a pointed, upwardly projecting prong 53 is formed on the outer end of the link 50 and, when the bolt 15 is in its extended position (FIG. 3), this prong is aligned with and immediately below an opening 54 in the top of the housing 16. When the bolt is in its normal extended position and the door 12 is locked, a force applied to the bolt and tending to drive it toward its retracted position (as indicated by the arrow A in FIG. 5) would push the bolt pin 43 to the inner end of the slot 51 in the bolt link.

Since the slot 51 is inclined at an angle to the horizontal, the bolt pin 49 moves toward the inner end of the slot (FIG. 5) and the link 50 pivots on the connection pin 43 rather than moving inwardly in a reciprocatory manner. The outer end of the link is thus lifted so that the prong 53 enters the opening 54 in the housing 16. The inner end of the opening serves as an abutment engaged by the prong to oppose the force applied to the bolt 15. Since the force is absorbed by the housing, it is not transmitted through the link to the ring 37 and connection pin 43. It should be noted that there is enough looseness in the linkage to permit the prong to move into firm engagement with the housing without stressing the connection pin.

To further strengthen the lock 10 and resist inwardly directed forces applied to the bolt 15, the link 50 caries a downwardly projecting tab 55 which is disposed immediately behind the inner end of the housing 16 when the bolt is fully extended (FIG. 2). A force applied to the link and, causing the link to pivot on the connection pin 43 as the bolt pin 49 slides to the inner end of the slot 51, will also cause the tab to engage the bottom inner end of the housing, as shown in FIG. 4. A second abutment is thus provided whereby the housing resists the force applied to the bolt and prevents that force from being transmitted to the connection pin and the ring 37. If the prong 53 and tab do not engage their respective abutments simultaneously, the connection pin will flex slightly to allow engagement at both locations.

If a force sufficient to break the connection pin 43 should be applied to the extended bolt 15 in a direction of movement from its retracted to its extended position, as might happen in the case of a blow that tends to open door 12, the forward end of the tab 55, that forms an inclined ramp surface, engages the aligned abutment on the inner bottom end of the housing 16. Simultaneously, the prong 53 engages an abutment on the housing formed by the outer end of the opening 54 so that the bolt link 50 becomes wedged in the housing. In this way, the force applied to the bolt is resisted by the housing and is not transmitted to the connection pin 43 and ring 37.

It will be apparent from the foregoing that the lock 10 of the present invention is of simple construction and is readily manufacturable. It has a smooth action that offers little resistance to its operation, but, at the same time, is highly secure and able to withstand large forces applied to the bolt.

While a particular embodiment of the invention has been illustrated and described, it will also be apparent that various modifications and changes can be made without departing from the spirit and scope of the invention.

I claim:

1. A door lock of the dead bolt type comprising:

a bolt;

a housing including a sleeve in which said bolt is reciprocable between a retracted position and an extended position, said housing having an opening therein;

a lock cylinder disposed within a transverse opening extending through a door, said cylinder having an eccentric rotatable cam on the inner end thereof;

a ring supported by said cylinder and rotatable thereon, said ring including an engagement portion extending beyond said cylinder and defining a recess engagable by said cam;

linkage means for causing reciprocation of said bolt in response to rotation of said ring;

a prong carried by said linkage means;

pin-and-slot means for lifting said prong into said opening to prevent movement of said bolt upon the application of a force to said bolt directed toward said retracted position, said catch including a slot that is inclined with respect to the reciprocation of said bolt in said housing;

abutment means carried by said linkage means and normally aligned with a portion of said housing for retaining said bolt in said housing when a force is applied to said bolt in its direction of movement from said retracted position to said extended position;

stop means for arresting rotation of said ring in first and second positions corresponding to said retracted and extended positions of said bolt, respectively; and resilient means disposed within said bolt for urging said bolt toward said extended position and for simultaneously urging said ring toward said first and second positions.

2. A door lock of the dead bolt type comprising:

a lock cylinder disposed within an opening extending transversely through a door, said cylinder having an eccentric rotatable cam on the inner end thereof;

a ring supported by said cylinder and rotatable thereon, said ring including engagement means extending beyond said cylinder for engagement by said cam upon rotation thereof;

a bolt reciprocable between a retracted position within said door and an extended position projecting from an edge of said door;

linkage means for connecting said bolt to said ring and for causing reciprocation of said bolt in response to rotation of said ring;

stop means for arresting rotation of said ring in first and second positions corresponding to said retracted and extended positions of said bolt, respectively; and resilient means for urging said ring toward said first and second positions.

3. The door lock of claim 2 wherein said resilient means is disposed within said bolt.

4. The door lock of claim 2 further comprising:

a housing in which said bolt is reciprocable;

an abutment carried by said housing; and catch means for engaging said abutment to prevent movement of said bolt upon the application of a force to said bolt directed toward said retracted position.

5. The door lock of claim 4 wherein said resilient means is disposed within said bolt.

6. A door lock of the dead bolt type comprising:

a lock cylinder disposed within an opening extending transversely through a door, said cylinder having an eccentric rotatable cam on the inner end thereof;

a ring supported by said cylinder and rotatable thereon, said ring including engagement means for engagement by said cam upon actuation thereof;

a bolt reciprocable between a retracted position within said door and an extended position projecting from an edge of said door; and linkage means for causing reciprocation of said bolt in response to rotation of said ring.

7. The door lock of claim 6 wherein said engagement means comprises a generally arcuate portion of said ring extending beyond said cylinder and having a discontinuity therein in which said cam can be received, said cam being out of engagement with said ring when not engaged by said discontinuity.

8. The door lock of claim 6 further comprising means for limiting movement of said cam away from said discontinuity to less the one half of a revolution.

9. The door lock of claim 6 wherein said cylinder is externally threaded and said ring is internally threaded, whereby said cylinder is threadedly engaged by said ring.

10. The door lock of claim 6 further comprising stop means for arresting rotation of said ring in first and second positions corresponding to said retracted and extended positions of said bolt, respectively.

11. The door lock of claim 10 wherein said first and second positions are separated by 180 degrees.

12. The door lock of claim 10 further comprising:

a security pin movably disposed within said bolt; and resilient means disposed within said bolt for urging said bolt toward said extended position and for urging said ring toward said first and second positions.

13. The door lock of claim 6 further comprising:

a housing in which said bolt is reciprocable;

an abutment on said housing; and catch means for engaging said abutment to prevent movement of said bolt upon the application of a force to said bolt directed toward said retracted position.

14. The door lock of claim 13 wherein said catch means comprises:

an opening in said housing by which said abutment is defined;

a prong carried by said linkage that is insertable in said opening; and means for causing insertion of said prong into said opening when said force is applied to said bolt.

15. A door lock of the dead bolt type comprising:

a lock cylinder disposed within an opening extending transversely through a door;

a rotatable ring concentric with said cylinder including an engagement portion defining a recess therein;

a bolt reciprocable between a retracted position within said door and an extended position projecting from an edge of said door; and linkage means for causing reciprocation of said bolt in response to rotation of said ring;

said cylinder including cam means eccentrically and rotatably mounted thereon for engaging one end of said recess to rotate said ring in one direction and for engaging an opposite end of said recess to rotate said ring in an opposite direction, whereby said bolt can be caused to reciprocate by rotation of said cam, said ring being shaped and dimensioned to limit movement of said cam away from said discontinuity to less than one-half of a turn.

16. The door lock of claim 15 wherein said discontinuity is a recess.

17. The door lock of claim 15 further comprising stop means for arresting rotation of said ring in first and second positions corresponding to said retracted and extended positions of said bolt, respectively.

18. The door lock of claim 17 further comprising resilient means for urging said ring toward said first and second positions.

19. The door lock of claim 15 further comprising:

a housing in which said bolt is reciprocable;

an abutment carried by said housing; and means for engaging said abutment to prevent movement of said bolt upon the application of a force to said bolt directed toward said retracted position.

20. The door lock of claim 15 wherein said engagement portion and said cam means are shaped and dimensioned to permit a full rotation of said cam means.

21. The door lock of claim 20 wherein said engagement portion and said cam means are shaped and dimensioned so that said engagement portion limits rotation of said cam means away from said recess to less than one-half a turn.

22. The door lock of claim 15 wherein said ring is supported by said cylinder and said engagement portion extends beyond said cylinder.

23. A door lock of the dead bolt type comprising:

a lock cylinder disposed within an opening extending transversely through a door;

a ring concentric with said cylinder and rotatable about said cylinder, said ring defining a discontinuity therein;

a bolt reciprocable between a retracted position within said door and an extended position projecting from an edge of said door; and linkage means for causing reciprocation of said bolt in response to rotation of said ring;

said cylinder including cam means eccentrically mounted thereon for engaging said discontinuity and thereby rotating said ring upon rotation of said cam means, said ring and said cam means being shaped and dimensioned to permit at least one full rotation of said cam means during which it engages and disengages said discontinuity.

24. The door lock of claim 23 wherein said discontinuity is a recess.

25. The door lock of claim 23 wherein said ring is supported by said cylinder.

26. The door lock of claim 23 further comprising stop means for arresting rotation of said ring in first and second positions corresponding to said retracted and extended positions of said bolt, respectively.

27. The door lock of claim 26 further comprising resilient means for urging said ring toward said first and second positions.

28. The door lock of claim 26 further comprising resilient means disposed within said bolt for urging said ring toward said first and second positions.

29. The door lock of claim 23 further comprising:

a housing in which said bolt is reciprocable;

an abutment carried by said housing; and means for engaging said abutment to prevent movement of said bolt upon the application of a force to said bolt directed toward said retracted position.

* * * * *